US005279417A

United States Patent [19]

Seaton

[11] Patent Number: 5,279,417

[45] Date of Patent: Jan. 18, 1994

[54] PACKAGE FOR HAND TOOLS

[75] Inventor: Robert A. Seaton, Madison, Wis.

[73] Assignee: Fiskars Oy Ab, Helsinki, Finland

[21] Appl. No.: 913,250

[22] Filed: Jul. 14, 1992

[51] Int. Cl.[5] ..... B65D 85/00

[52] U.S. Cl. ..... 206/349; 206/461; 206/470

[58] Field of Search ..... 206/349, 461, 467–471

[56] References Cited

U.S. PATENT DOCUMENTS

| | | | |
|---|---|---|---|
| 3,972,417 | 8/1976 | Iten et al. . | |
| 4,165,805 | 12/1979 | Fethke et al. . | |
| 4,179,029 | 8/1979 | Fethke et al. . | |
| 4,512,474 | 4/1985 | Harding . | |
| 4,714,159 | 12/1987 | Linden | 206/349 |
| 4,749,082 | 6/1988 | Gardiner et al. | 206/349 |
| 4,872,551 | 10/1989 | Theros | 206/471 |
| 4,899,877 | 2/1990 | Kiernan | 206/349 |
| 5,129,516 | 7/1992 | Theros | 206/471 |

FOREIGN PATENT DOCUMENTS

| | | | |
|---|---|---|---|
| 2444606 | 4/1976 | Fed. Rep. of Germany | 206/349 |
| 1242088 | 8/1971 | United Kingdom | 206/461 |
| 2215298 | 9/1989 | United Kingdom | 206/461 |

*Primary Examiner*—Jimmy G. Foster
*Attorney, Agent, or Firm*—Foley & Lardner

[57] ABSTRACT

A functional package for hand tools such as scissors, pliers, pruners, snippers, clippers, or other hand tools is disclosed. The package is a point of sale display container which can accommodate straight handled tools. Both blister packages and clam packages are disclosed. The blister package and clam package hold a first handle of the tool substantially stationery and allow a second handle of the tool to be manipulated by a customer. Preferably, an aperture or hole is provided to manipulate locking controls or switches.

14 Claims, 3 Drawing Sheets

PACKAGE FOR HAND TOOLS

TECHNICAL FIELD

This application is related to U.S. Pat. No. 4,165,805, issued to Fethke et al. on Aug. 28, 1979 and U.S. Pat. No. 4,179,029, issued to Fethke et al. on Dec. 18, 1979. Both patents are assigned to the assignee of the present invention.

BACKGROUND OF THE INVENTION

This invention relates to packages for displaying hand tools and particularly at point of sale displays. More specifically, this invention relates to packages which house hand tools in a manner allowing them to be operated while in the package so the customer can experience the feel of the handle and operation of the tool without opening the display package. The invention relates to both blister packages and clam packages.

Blister packages customarily are used to mount small items of hardware, stationary and other goods on a display card under a blister covering made of transparent, stiff, but flexible material such as polyvinyl chloride (PVC) and applied to the display card by heat and pressure-adhesive techniques. Blister packages have been described in U.S. Pat. No. 4,179,029 entitled "Blister Packages for Scissors, Pliers and Other Hand Tools," issued to Fethke et al. on Aug. 28, 1979, and 4,165,805 entitled, "Functional Blister Package for Snipper-Type Scissors," issued to Fethke et al. on Dec. 18, 1979.

The '029 patent and the '805 patent show hand tools with a pair of loop handles. The packages are designed as packages which enable the customer to operate the tool while it remains in the package. One loop handle is freely movable and the other loop handle is totally enclosed by the blister packaging. This configuration for the blister packaging is sometimes disadvantageous because the user does not get the feel of the handle which is completely enclosed by the covering. Further, this configuration can be disadvantageous because hand tools with non-looped or straight handles cannot readily be accommodated by this style of packaging.

A clam package utilizes two surfaces shaped in the form of the product which is to be held. The surfaces generally are snapped or otherwise held together by mechanical or adhesive methods.

Alternatively, the two pieces may be manufactured so the surfaces include integral snap-over edges or snap-together elements for resilient engagement. Further still, a clam package can be manufactured using a clasp made from a peg and a hole which securely fasten the two surfaces together. U.S. Pat. No. 4,512,474 entitled, "Locking Display Package," issued to Harding on Apr. 23, 1985, discloses a clam package with two pieces held together by an interlocking means including a round female portion and a square male portion.

Heretofore, clam packages have not been designed so a hand tool can be functionally displayed within the package. Generally, a customer has been required to open the clam package, thereby destroying its integrity, to get the "feel" of the hand tool. Thus, clam packages have not been designed so that a customer can operate a hand tool while it remains in the package.

Thus, there is a need for a package of the foregoing ilk which can accommodate non-looped hand tools such as clippers, pruners or other hand tools. Further, there is a need for a package which enables the user to feel both handles. Further still, there is a need for a clam-style package of this sort.

SUMMARY OF THE INVENTION

The foregoing limitations are overcome by a package in accordance with the present invention, specifically adapted to hold a tool having two handles. The instant package includes a transparent panel overlying working surfaces of the tool and encasing at least a portion of a first member of the tool. The package also includes an opposed panel underlying working surfaces of the tool and encasing at least a portion of the first member. An aperture is disposed through both of the panels proximate the handle of the first member. The aperture is dimensioned to accept the finger portion of a human hand intended to grasp the tool when in use. A lateral slot formed in at least one of the panels intermediate the length of the tool allows a second member of the tool to project out of the package. The tool may be manipulated and the working surfaces operated while the tool is housed in the package.

The present invention also relates to a blister package adapted to hold a tool. The present invention further relates to a clam package adopted to hold a tool.

The present invention further relates to a package including an opening for exposing a locking means on the hand tool.

The present invention further still relates to a package including an abutment to hold the handle of the first member.

BRIEF DESCRIPTION OF THE DRAWINGS

The preferred exemplary embodiment of the present invention will hereinafter be described in conjunction with the appended drawings, wherein like designations denote like elements, and.

DETAILED DESCRIPTION OF PREFERRED EXEMPLARY EMBODIMENTS OF THE PRESENT INVENTION

Figure 1:
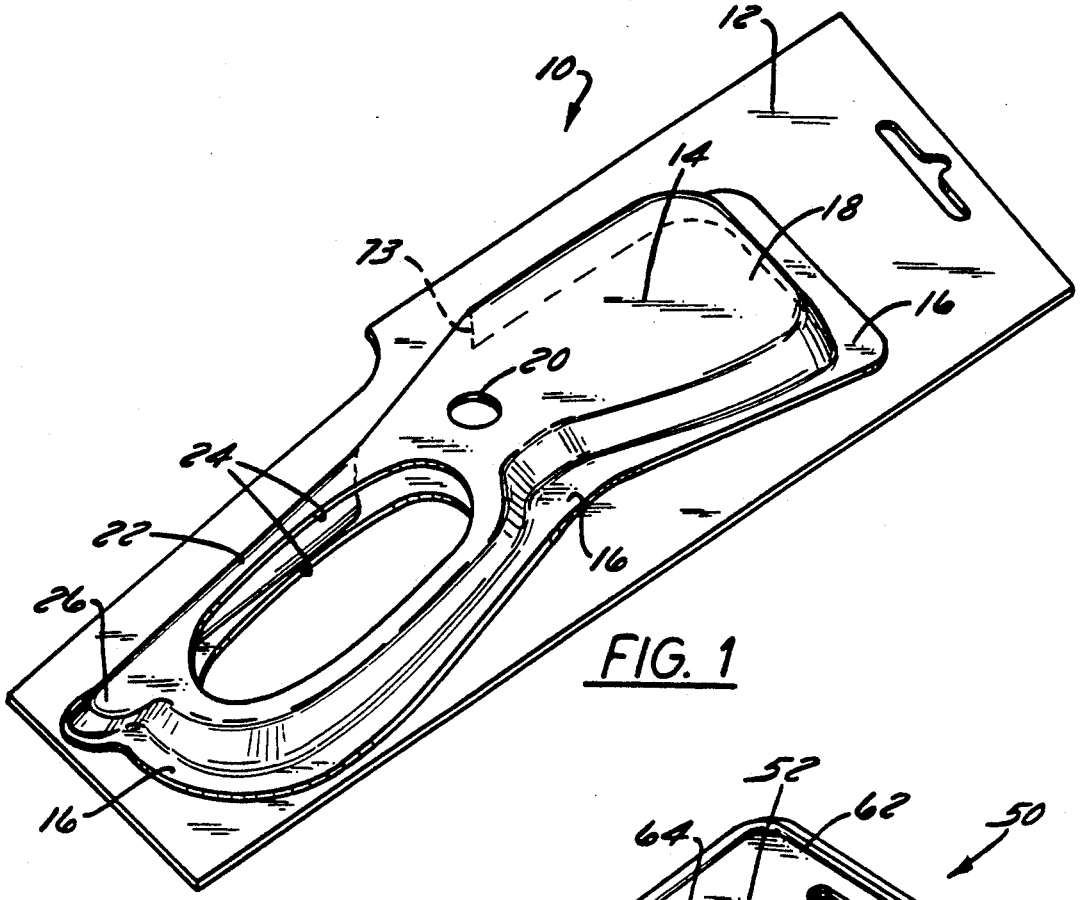
FIG. 1 is a drawing of a first preferred exemplary embodiment of the present invention.

With reference to FIG. 1, a blister package 10 in accordance with a first preferred exemplary embodiment of the present invention includes a display card 12 and a covering 14. Blister package 10 is suitable for holding hand tools, snippers, scissors, hardware or other articles. Display card 12 provides a bottom panel for blister package 10.

Preferably, covering 14 is a transparent panel. Covering 14 and display card 12 are shaped to accommodate the shape of a tool to be displayed, shown for example in FIGS. 3 and 4. Display card 12 is preferably made of cardboard and can carry various marketing or advertising information.

Preferably, covering 14 is applied to display card 12 by heat or pressure-adhesive means. Other mechanical or chemical approaches may alternatively be used to attach covering 14 to display card 12. Covering 14 is generally an elongated plastic blister panel made of transparent, stiff, but flexible material such as polyvinyl-chloride (PVC).

Covering 14 has an outwardly bent edge running around a significant portion of its periphery such as a rim 16. Rim 16 is provided around almost the entire periphery of an opening 24 in order to provide support for covering 14. Covering 14 may be sealed to display card 12 along rim 16. By this arrangement, covering 14 generally has a "U" shaped cross-section.

Package 10 provides a cavity at a head section 18 of covering 14. The cavity is located between covering 14 and display card 12. Working surfaces of the tool may be held in the cavity in head section 18.

A tail section 22 of covering 14 generally outlines at least one straight handle of the tool. The tool is generally held in the cavity by the shape of tail section 22 and head section 23 of covering 14. Blister package 10 also includes an abutment 26 in tail section 22 for holding the straight handle of the tool. Abutment 26 generally defines a cavity for holding the tool.

Opening 24 is a hole or aperture provided in tail section 22 of covering 14 and display card 12. Opening 24 is large enough to allow a customer to grasp the tool. Covering 14 also includes an aperture 20, allowing a button, lever, or other control associated with the tool to be manipulated while in the package.

Figure 2:
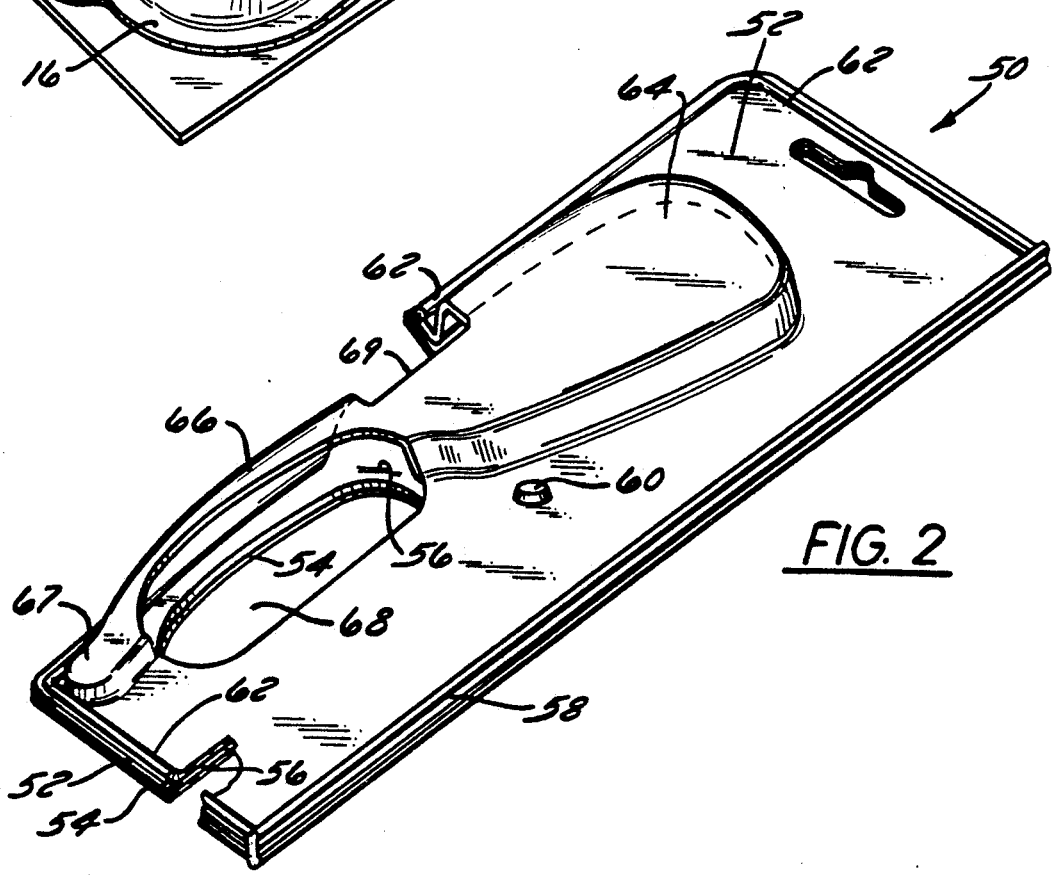
FIG. 2 is a drawing of a second preferred exemplary embodiment of the present invention.

With reference to FIG. 2, a clam package 50 includes a top surface 52 and a bottom surface 54 in accordance with a second exemplary embodiment of the present invention. Clam package 50 is suitable for use with hand tools, snippers, clippers, hardware or other articles. A display card 56 may be provided between top surface 52 and bottom surface 54. Display card 56 may provide various marketing information related to a hand tool shown for example in FIGS. 3 and 4. Display card 56 is generally shaped in accordance with top surface 52 and bottom surface 54.

Generally, top surface 52 is a transparent panel folded onto bottom surface 54 at a fold 58. Bottom surface 54 is an opposed panel interlocked into top surface 52 by means of an interlocking peg 60 and edges 62. As is well known in the art, edges 62 and interlocking peg 60 are sized so that bottom surface 54 and top surface 52 are in resilient engagement when pressed together. Of course, various means for interlocking bottom top surface 52 and bottom surface 54 may be utilized. For instance, mechanical or adhesive means may be applied to top surface 52 and bottom surface 54 to lock top surface 52 to bottom surface 54.

When top surface 52 is pressed to bottom surface 54 across fold 58, clam package 50 is formed. Clam package 50 may also be formed of an independent top surface 52 and an independent bottom surface 54 without the use of a fold 58.

Preferably, top surface 52 and bottom surface 54 are generally planar. However, a head portion 64 of top surface 52 provides a cavity between top surface 52 and bottom surface 54 for holding a tool. Further, tail portion 66 of top surface 52 is shaped in accordance with at least one handle of the tool. Preferably, an abutment 67 on surfaces 52 and 54 are shaped to hold the end of the handle.

An opening 68 is provided through a tail portion 66 of top surface 52. Opening 68 is an aperture or hole large enough to accommodate a customer's fingers. Opening 68 should be provided through display card 56.

A portion 69 of top surface 52 is cut away to expose a switch element, button, or control on the tool. Portion 69 allows the switch element, button, or control on the tool to be manipulated by the customer.

Preferably, top surface 52 and bottom surface 54 are transparent plastic panels as is well known in the art. Such surfaces 52 and 54 are produced by Plastic Ingenuity, Inc located in Cross Plains, Wisconsin. Preferably, top surface 52 and bottom surface 54 are made from PVC.

Figure 3:
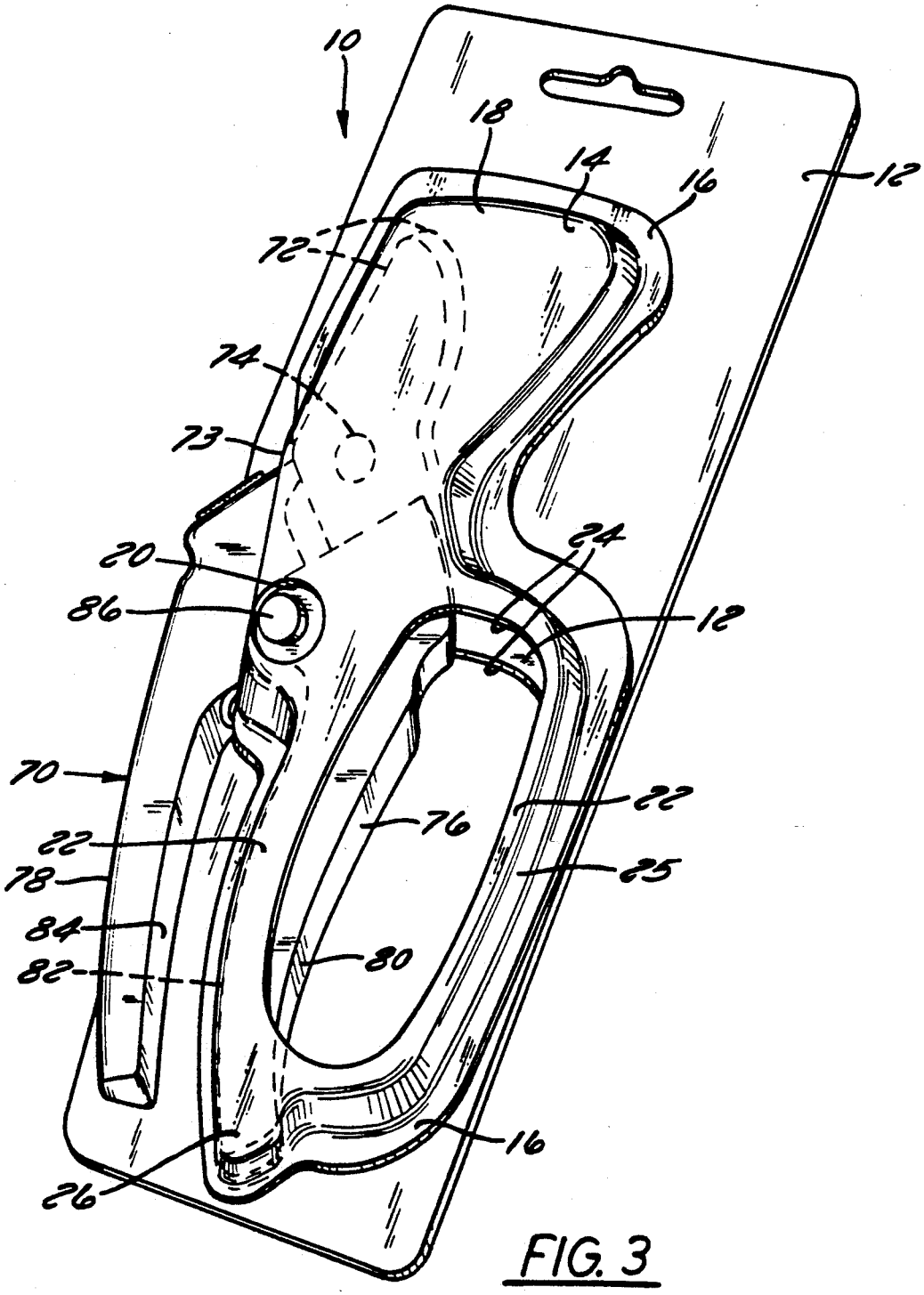
FIG. 3 is a drawing of the first preferred exemplary embodiment of the present invention.

With reference to FIG. 3, blister package 10 in accordance with the first embodiment of the present invention holds a tool 70. Tool 70 is a snippers, pruner, wire cutter, or other device. Tool 70 includes working surfaces 72. Working surfaces 72 are pivotably coupled about a pin or axle 74. Tool 70 also includes a first handle 76 and a second handle 78. A first inside surface 82 of handle 76 is adjacent to a second inside surface 84 of handle 78. Tool 70 also includes a first outside surface 80 on handle 76.

Working surfaces 72 are cutters, blades, anvils blades, crimping apparatus or other operating instruments. Working surfaces 72 are covered by the cavity formed between display card 12 and covering 14 in head portion 18 of blister package 10. Inside surface 82 is substantially covered by covering 14. Covering 14 covers a portion of outside surface 80 of handle 76. This arrangement holds tool 70 substantially stationary in package 10.

A button 86 on tool 72 provides a locking mechanism. Opening 20 allows button 86 to be manipulated. After a customer unlocks tool 70 by releasing button 86, the customer may manipulate tool 70 by grasping handle 76 through opening 24. The cavity at head portion 18 of package 10 allows working surfaces 72 to be moved over a substantial range while in package 10. Handle 78 exits a lateral slot 73 between covering 14 and card 12. Handle 78 is substantially free from covering 14 so that handle 78 can be moved relative to handle 76.

Abutment 26 holds handle 76 relatively stationary in package 10. Covering 14 is designed so handle 76 cannot be slid out of abutment 26. Rim 16 provides support on side 25 of hole 24. The support provided by rim 16 provides stability for package 10.

A spring (not shown) is allowed to expand between handle 76 and handle 78. Covering 14 is designed to allow a cavity or tunnel to be formed near or as part of slot 73. Preferably, the spring, coupled to handles 76 and 78, is attached adjacent to button 86.

Figure 4:
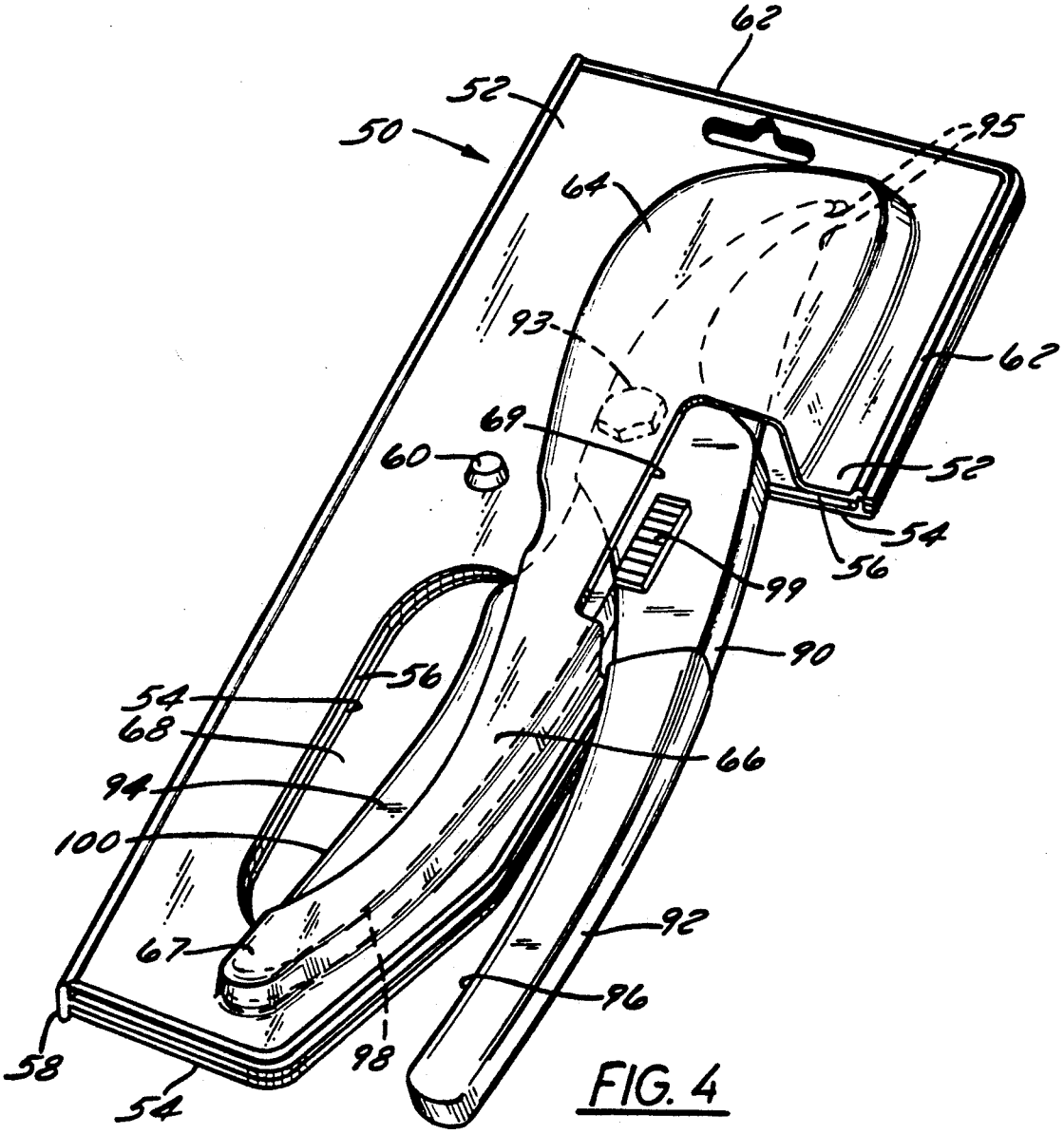
FIG. 4 is a drawing of the second preferred exemplary embodiment of the present invention.

With reference to FIG. 4, a clam package 50 in accordance with the second exemplary embodiment of the present invention includes top surface 52, bottom surface 54, and display card 56. Clam package 50 holds a tool 90. Tool 90 is preferably a hand tool, anvil pruner, bypass pruner or other manually operated device.

Tool 90 includes a first handle 94 and a second handle 92. Handle 94 includes a first inside surface 98 adjacent to second inside surface 96 on handle 92. Handle 94 also includes a first outside surface 100. Outside surface 100 is partially covered by top surface 52. Inside surface 66 is almost entirely covered by top surface 52. Preferably, the bottom surface 54 covers handle 94 in a similar manner.

Cavity 64 allows working surfaces 95 of tool 90 to be substantially moved inside clam package 50. Working surfaces 95 are manipulated about a pivot point 93. Opening 68 is preferably large enough to allow a customer to grasp handle 94 of tool 90. Portion 69 is cut away, molded or otherwise designed so that top surface 54 does not cover a switch 99. Switch 99 is a control, button, lever or other means for controlling tool 90.

Abutment 67 holds handle 94 substantially stationary relative to top surface 52. Preferably, package 50 is designed so that handle 92 may be freely moved without obstruction from clam package 50. Thus, a customer may operate tool 90 by placing fingers through opening 68.

It will be understood that while various embodiments are depicted in the drawings or figures, they are not shown in a limiting sense. The above description is of preferred exemplary embodiments of the present invention and is not limited to the specific forms shown. For example, while particular shapes of the various surfaces and cards are shown, various other shapes could be used without departing from the spirit of the invention. Also, other modifications to the various openings and materials used in the packages could be modified without departing from the spirit of the invention as expressed in the appended claims.

I claim:

1. A package holding and displaying a tool at the point of sale, said tool having first and second members pivotally connected for relative movement, each of said members having a handle and respective working surfaces lying across the pivotal connection, said package comprising:

(a) a first panel overlying the working surfaces of said tool and for encasing at least a portion of said first member, including the handle thereof, said first panel having a head portion, an opposed tail portion, and a pair of edges extending from said head portion to said tail portion;

(b) an opposed panel underlying the working surfaces of said tool and for encasing at least a portion of said first member, including the handle thereof, said opposed panel having a head portion, an opposed tail portion, and a pair of edges extending from said head portion to said tail portion;

(c) an aperture disposed through both of said panels proximate the location for said handle of said first member, dimensioned to accept the finger portion of a human hand intended to grasp said tool when in use; and (d) a lateral slot formed in at least one of said panels disposed intermediate the other of said edges, through which projects the handle of said second member from a point distal of said pivotal connection;

wherein the tool has a locking control disposed proximate the pivotal connection and said lateral slot is located sufficiently proximate the pivotal connection to expose, and permit operation of, the locking control, whereby said tool may be manipulated and said working surfaces operated while housed in said package to demonstrate the use of said tool without opening said package.

2. The package of claim 1 wherein said first panel is transparent.

3. The package of claim 1 wherein a fold is formed integrally with said first and opposed panels.

4. The package of claim 3, further comprising:

a display card disposed in between said first and opposed panels.

5. The package of claim 4, wherein said display card has an opening.

6. The package of claim 1 wherein said handle of said first member terminates at a distal end and wherein said first panel includes an abutment disposed substantially adjacent said aperture, said distal end engaging said abutment when said tool is disposed in said package.

7. A clam package adapted to hold a tool and display the same at the point of sale, said tool having first and second members pivotally connected for relative movement, said members having respective handles and working surfaces lying across the pivotal connection, said handles terminating at respective distal ends, said package comprising:

(a) a first panel for overlying the working surfaces of said tool and for encasing at least a portion of said first member, including the handle thereof, said first panel having a first pair of opposed edges extending in a direction generally parallel to said handles;

(b) an opposed panel for underlying the working surfaces of said tool and for encasing at least a portion of said first member, including the handle thereof, said opposed panel having a second pair of opposed edges extending in a direction generally parallel to said handles, said opposed panel integrally formed with said first panel and being foldably engaged along a first edge of said first pair and a first edge of said second pair, said opposed panel and said first panel having a fold along a second edge of said first pair and a second edge of said second pair to form said clam package;

(c) an aperture disposed through both of said panels proximate the location for said handle of said first member, dimensioned to accept the finger portion of a human hand intended to grasp said tool when in use;

(d) a lateral slot formed in at least one of said panels disposed intermediate the second edge of said first pair, through which may project the handle of said second member from a point distal of said pivotal connection;

whereby said tool may be manipulated and said working surfaces operated while housed in said package to demonstrate the use of said tool without opening said package.

8. The clam package of claim 7, wherein said first panel is shaped so that a switch element on the tool may be manipulated.

9. The clam package of claim 7 further comprising a display card located between said first and opposed panels.

10. The package of claim 7 further comprising an interlocking means for coupling said first and opposed panels.

11. The package of claim 10 wherein said interlocking means is located adjacent the pivotal connection.

12. The package of claim 11 wherein said interlocking means is circular.

13. The package of claim 7, wherein said first and opposing panels are made of PVC.

14. The package of claim 7 wherein said first panel further comprises an abutment disposed proximate said aperture, said distal end of said first handle engaging said abutment when said tool is disposed in said package.

* * * * *